US006640602B2

(12) United States Patent
Estes

(10) Patent No.: US 6,640,602 B2
(45) Date of Patent: Nov. 4, 2003

(54) DUAL NOTCHER

(75) Inventor: Stephen R. Estes, South Bend, IN (US)

(73) Assignee: SSD Control Technology, Inc., South Bend, IN (US)

( * ) Notice: Subject to any disclaimer, the term of this patent is extended or adjusted under 35 U.S.C. 154(b) by 41 days.

(21) Appl. No.: 10/081,527

(22) Filed: Feb. 22, 2002

(65) Prior Publication Data

US 2002/0121124 A1 Sep. 5, 2002

Related U.S. Application Data

(60) Provisional application No. 60/272,908, filed on Mar. 2, 2001.

(51) Int. Cl.[7] ..... B21D 28/10

(52) U.S. Cl. ..... 72/326; 83/54; 83/191; 83/917

(58) Field of Search ..... 72/326, 325, 404, 72/471; 83/54, 191, 188, 917

(56) References Cited

U.S. PATENT DOCUMENTS 1,679,572 A * 8/1928 Hayden ..... 83/588
1,895,589 A * 1/1933 Spatta ..... 83/36
3,270,604 A * 9/1966 Waltonen ..... 83/140
4,205,545 A * 6/1980 Andrews ..... 72/326
4,334,703 A * 6/1982 Arthur et al. ..... 285/222
4,621,553 A * 11/1986 Gruchalski et al. ..... 83/194

FOREIGN PATENT DOCUMENTS

CA 947194 * 5/1974 ..... 83/54
SU 919788 * 4/1982 ..... 72/326

* cited by examiner

*Primary Examiner*—Daniel C. Crane
(74) *Attorney, Agent, or Firm*—Marshall, Gerstein & Borun LLP

(57) ABSTRACT

A device for simultaneously forming multiple notches in opposing surfaces of a hollow workpiece in a single action. The device includes a first die and a first punch that is fixed relative to the first die. A second die and a second punch are fixed relative to each other and movable relative to the first punch and first die. In response to movement of the second die and second punch, the first die cooperates with the second punch to form a first notch in the first surface and the first punch cooperates with the second die to form a second notch in the second surface.

11 Claims, 11 Drawing Sheets

DUAL NOTCHER

CROSS-REFERENCE TO RELATED APPLICATION

This application claims the benefit under 35 U.S.C. §119 (e) of U.S. provisional patent application Ser. No. 60/272,908 filed Mar. 2, 2001, the disclosure of which is incorporated herein by reference.

FIELD OF THE INVENTION

The present invention relates generally to notching equipment, and more specifically to a device that is capable of forming two notches in a hollow workpiece in the same action.

BACKGROUND OF THE INVENTION

Polyvinyl tubing is commonly used for many purposes, including by way of example rather than limitation, fencing, decking, lawn furniture etc. In such applications, it is often required that the polyvinyl tubing be processed in one or more ways. For example, in many applications notches must be formed into two or more of the sidewalls in order to permit an end portion of one piece of tubing to be inserted and securely locked in a receiving aperture in another piece of tubing. In an application such as polyvinyl fence systems, for example, the notched end of one tubular polyvinyl fence rail is inserted into a receiving aperture in a tubular polyvinyl fence post, thereby forming an easy to assemble joint.

The processing of such components often requires the polyvinyl tubing to go through several repetitions in a notching die to create a single complete section of tubing. In such a process, the workpiece (e.g. a piece of hollow polyvinyl tubing or some other tubing material) is aligned and inserted into the notching die. The die is cycled to create a notch on a first surface, and then the workpiece is removed from the die and reoriented. The reoriented workpiece is again inserted into the die to create another notch on a second surface. This process is repeated until the desired number and location of notches is achieved.

In order to improve processing efficiencies it may be desirable to create multiple notches in a single action.

DETAILED DESCRIPTION OF THE PREFERRED EMBODIMENT

The following description of the disclosed embodiment is not intended to limit the scope of the invention to the precise form or forms detailed herein. Instead, the following description is intended to be illustrative of the principles of the invention so that others may follow its teachings.

Figure 1:
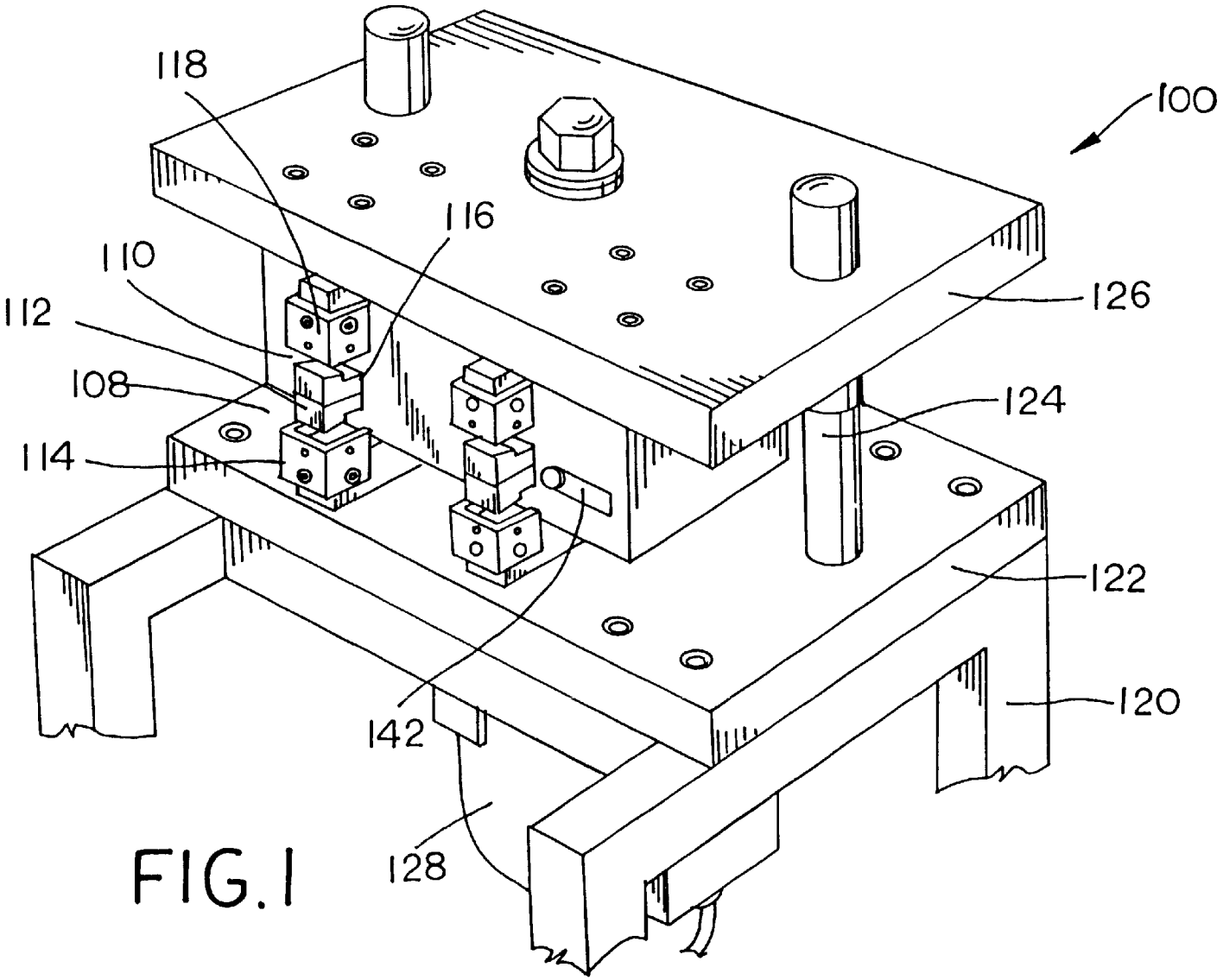
FIG. 1 is perspective view of a device for notching a hollow workpiece assembled in accordance with the teachings of the present invention.

Referring now to the drawings, FIG. 1 illustrates a notching device assembled in accordance with the teachings of the present invention is generally referred to by the reference numeral 100. It will be understood that the notching device 100 may be used to create notches 101 (viewable in each of FIGS. 4, 6, 10 and 11) in opposing surfaces, i.e., a lower surface 102 and an upper surface 104, of a hollow workpiece 106 (shown in FIG. 3) as will be described below. The notching device 100 includes a lower die set 108 and an upper die set 110. Preferable both the lower die set 108 and the upper die set 110 are manufactured from tool steel, such as S-7, A-2, and/or 0–6, all of which are commonly employed in the art. The lower die set 108 and the upper die set 110 are also heat treated and ground into their final configuration.

The lower die set 108 includes a downward facing punch 112 and a corresponding upward facing die 114. The upper die set 110 includes a upward facing punch 116 and a corresponding downward facing die 118. A support frame 120 is provided, and a fixed plate 122 is mounted to the support frame 120. A pair of guide rods 124 are mounted to the fixed plate 122.

An actuator 128, which may be for example, a commercially available Bimba® 8" diameter linear actuator, is provided and is operatively connected to the movable plate 126. Accordingly, the moveable plate 126 will move up and down relative to the fixed plate 122 in response to actuation of the actuator 128, with the moveable plate 126 being guided by the guide rods 124. A commercially available die set, such as a Danly IEM® AS-34, which includes the fixed plate 122, the movable plate 126 and the guide rods 124 may be used, if so desired.

Figure 2:
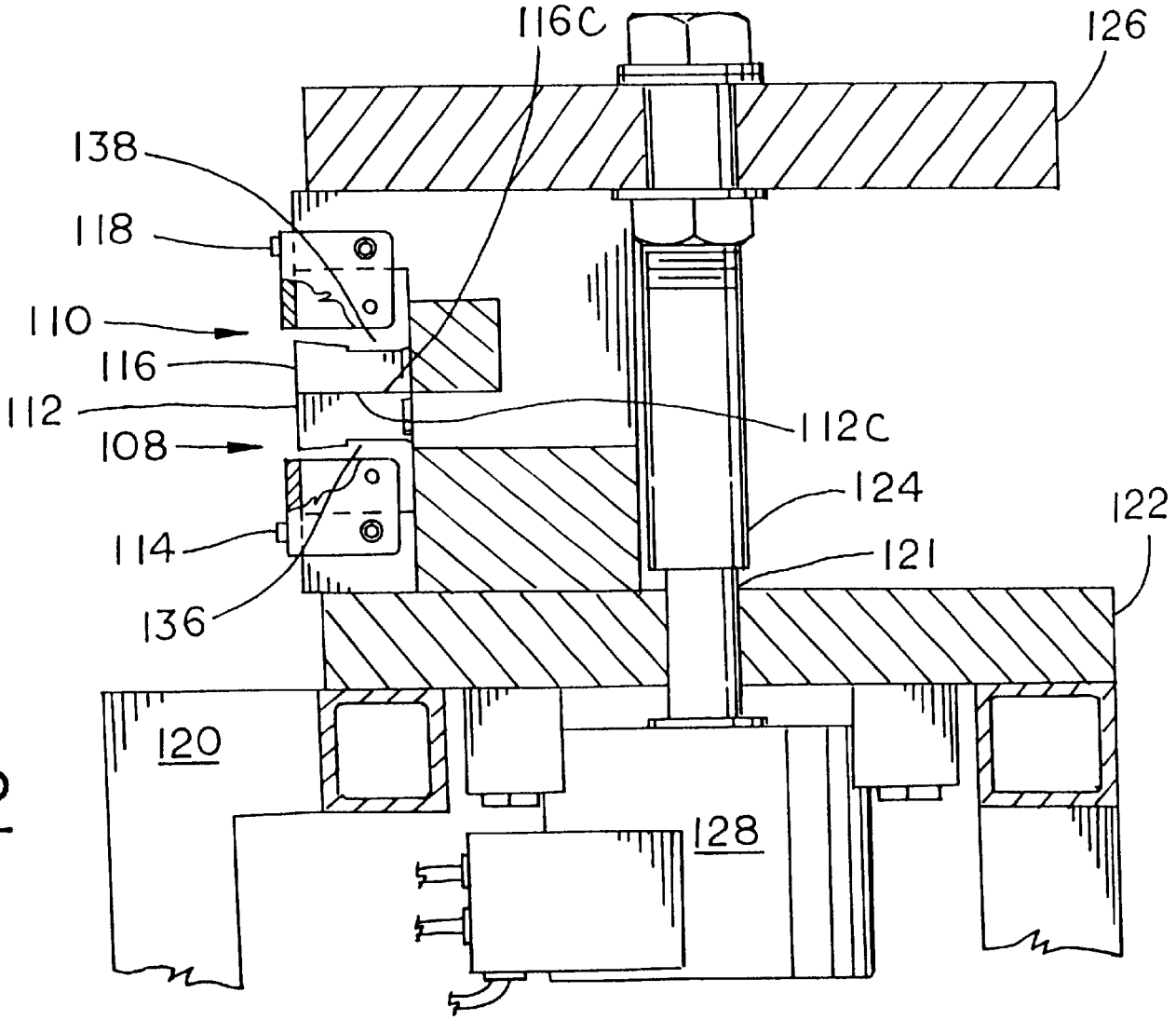
FIG. 2 is a side elevational view of the apparatus illustrated in FIG. 1 and illustrating the fixed and moving elements of the apparatus.

Turning now to FIG. 2, the die 114 of the of the lower die set 108 and the upward facing punch 116 of the upper die set 110 are both mounted to the fixed plate 122, while the downward facing punch 112 of the lower die set 108 and the die 118 of the upper die set 110 are both mounted to the moveable plate 126.

Figure 9:
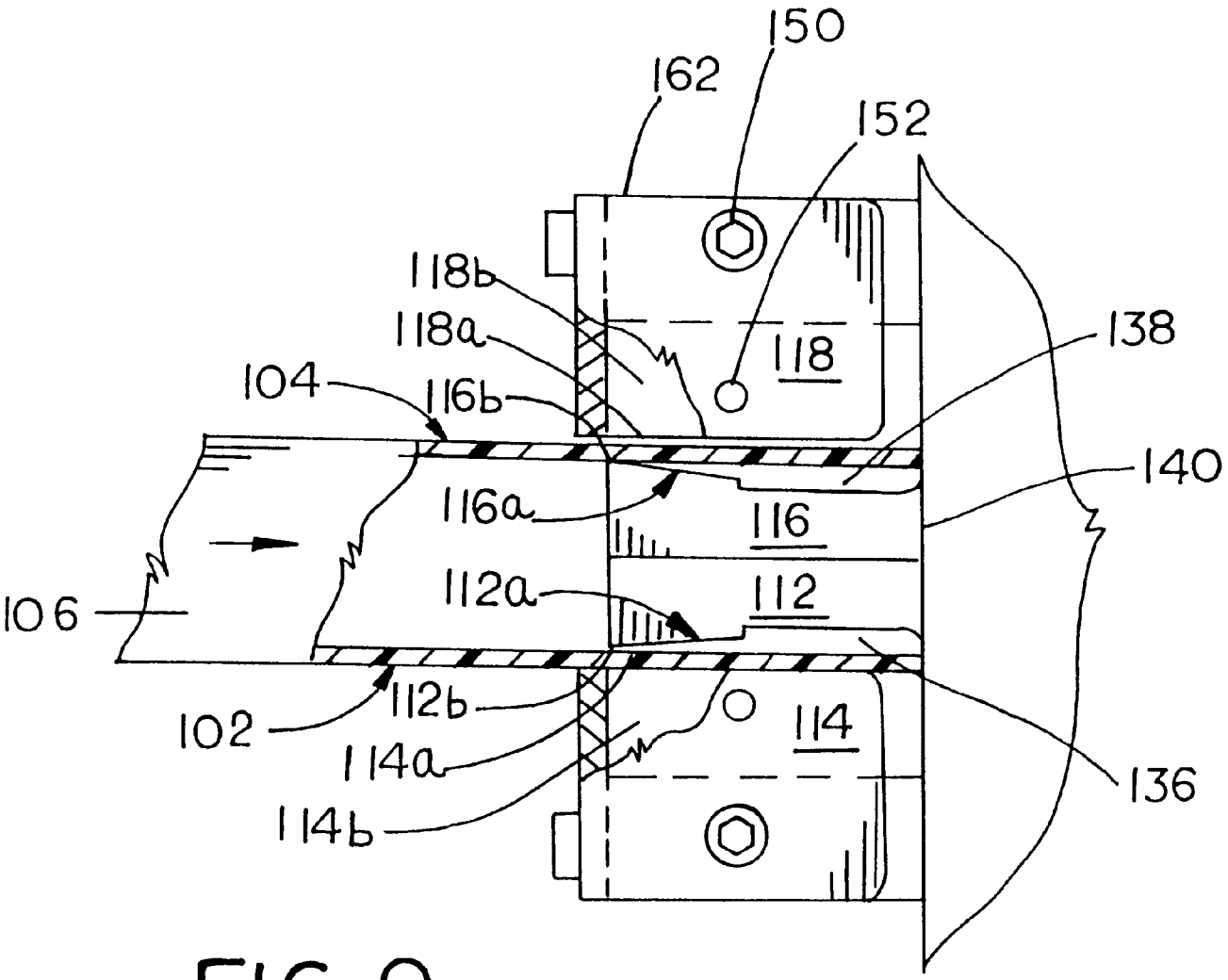
FIG. 9 is an enlarged fragmentary cross-sectional view taken along line 9—9 of FIG. 7.

Referring to FIG. 9, the punches 112, 116 each include a sloping portion 112*a*, 116*a*, respectively, which terminates in a tip 112*b*, 116*b*, respectively. The die 114 includes an edge 114*a* which generally surrounds a die cavity 114*b*. Similarly, the die 118 includes an edge 118*a* which generally surrounds a die cavity 118*b*. It will be noted that die cavity 114*b* is sized to receive the sloping portion 112*a* and the tip 112*b* of the punch 112, while the die cavity 118*b* is sized to receive the sloping portion 116*a* and the tip 116*b* of the punch 116.

Figure 3:
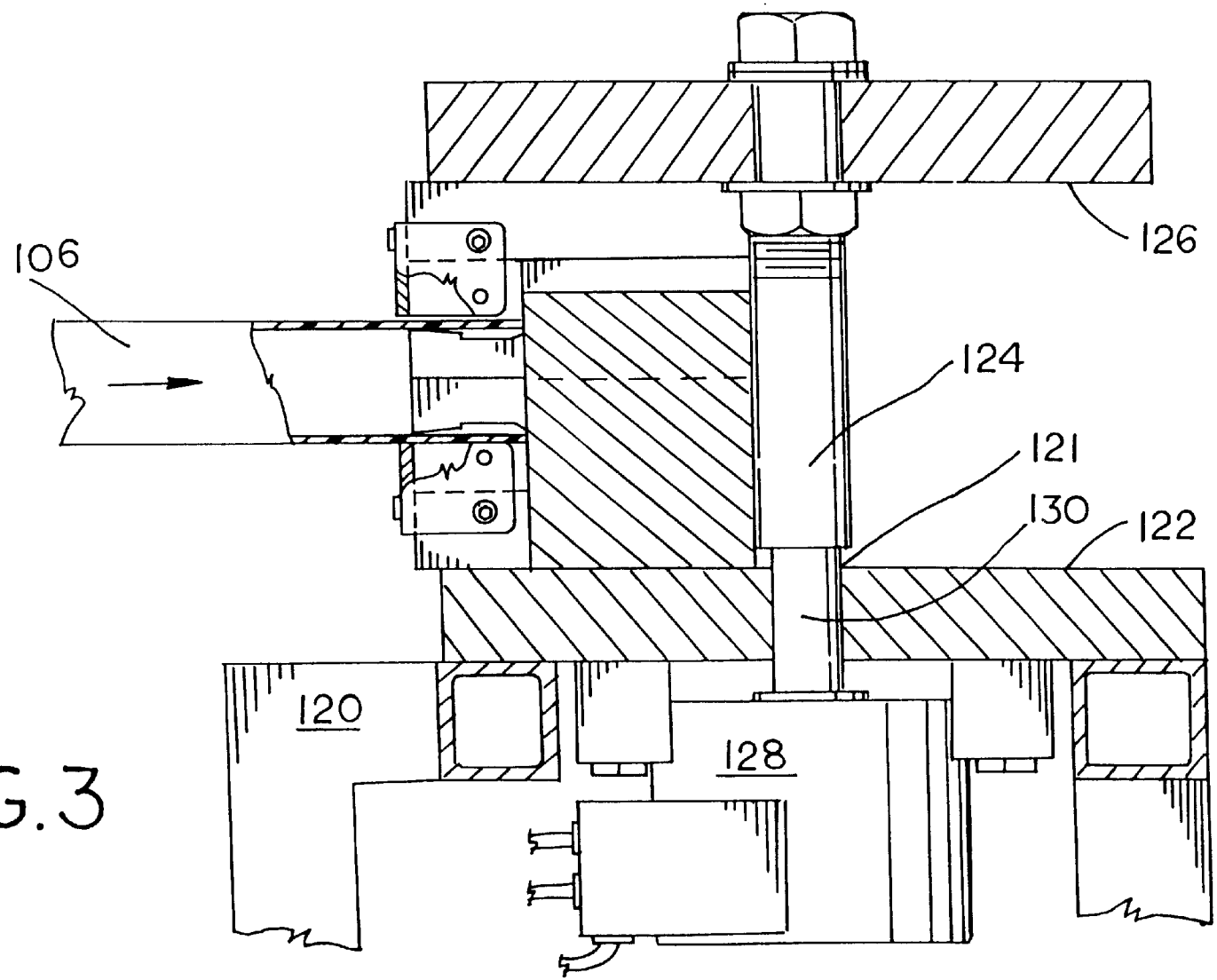
FIG. 3 is a side elevational view similar to FIG. 2 but illustrating the workpiece installed in the apparatus.

As shown in FIG. 3, the actuator 128 includes a rod 130 which is operatively connected to the moveable plate 126. Accordingly, in response to operation of the actuator 128, the rod 130 will reciprocate up or down when viewing FIGS. 4 and 5, thus causing the moveable plate 126 to move relative to the fixed plate 122. In the disclosed embodiment the guide rods 124 serve to ensure that the moveable plate 126 moves along a relatively straight path.

Figure 4:
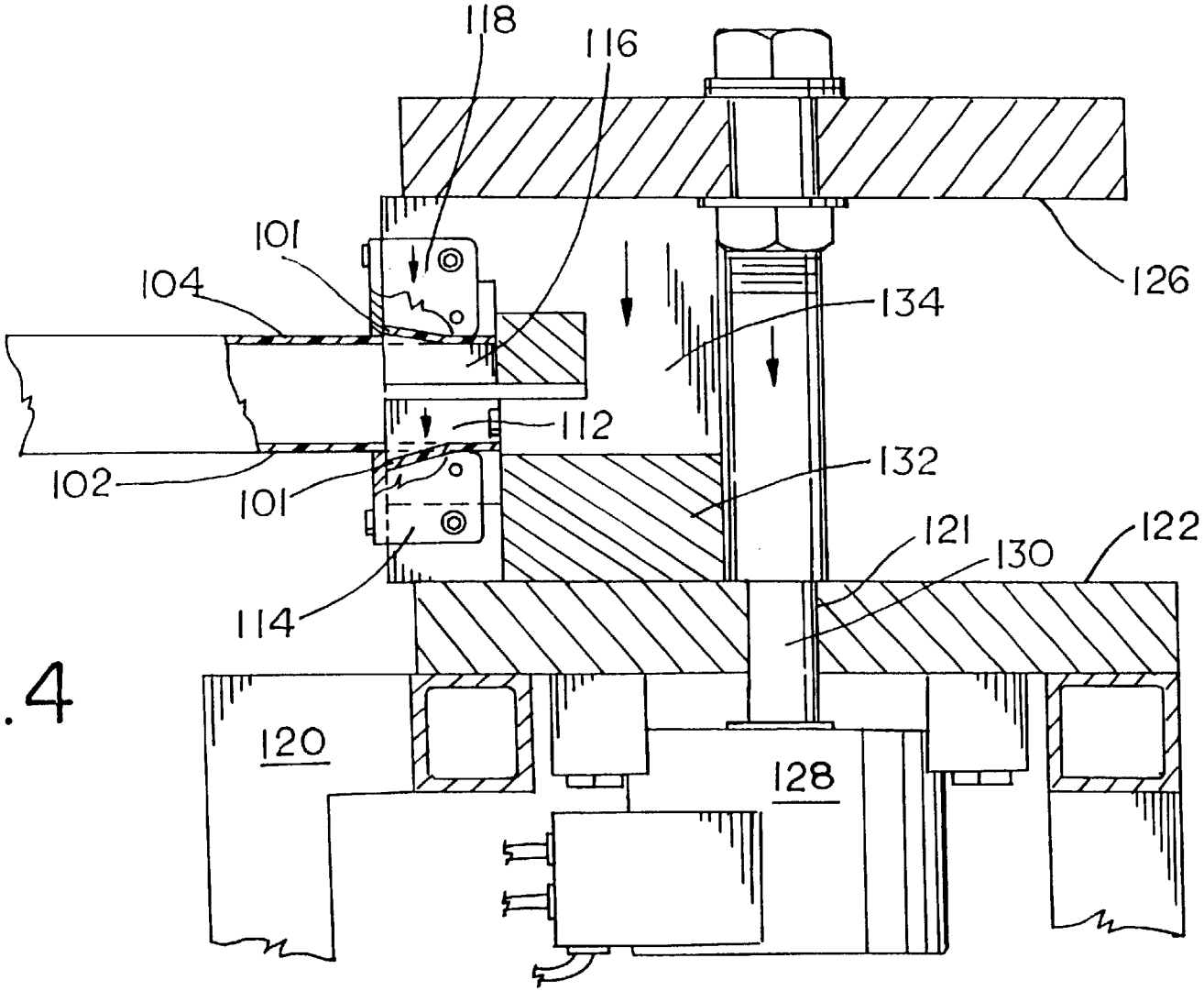
FIG. 4 is a side elevational view similar to FIGS. 2 and 3 but showing the apparatus in the active or notch forming position.
Figure 5:
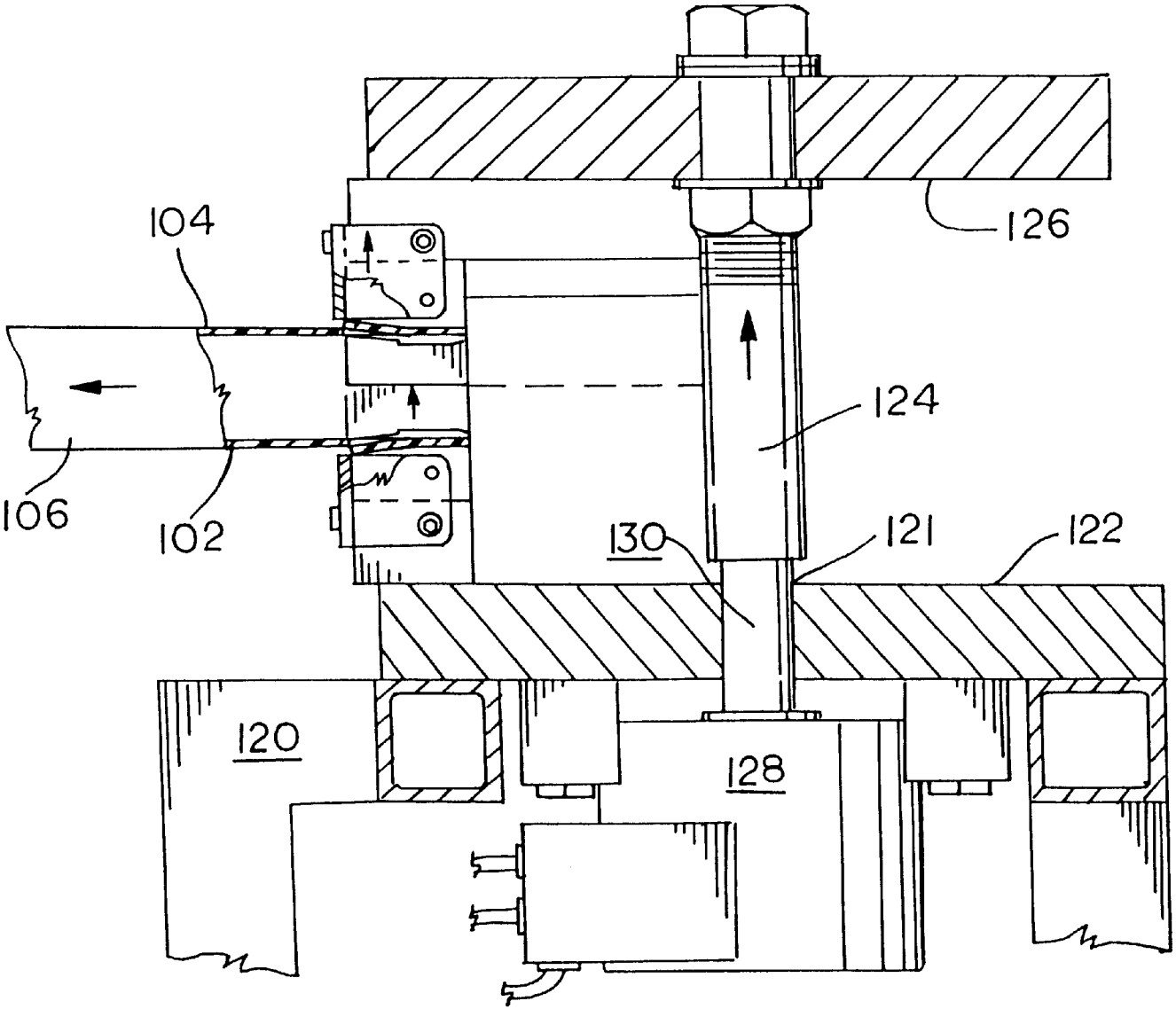
FIG. 5 is a side elevational view similar to FIGS. 2 through 5 but showing the apparatus moving toward the inactive or retracted position.
Figure 6:
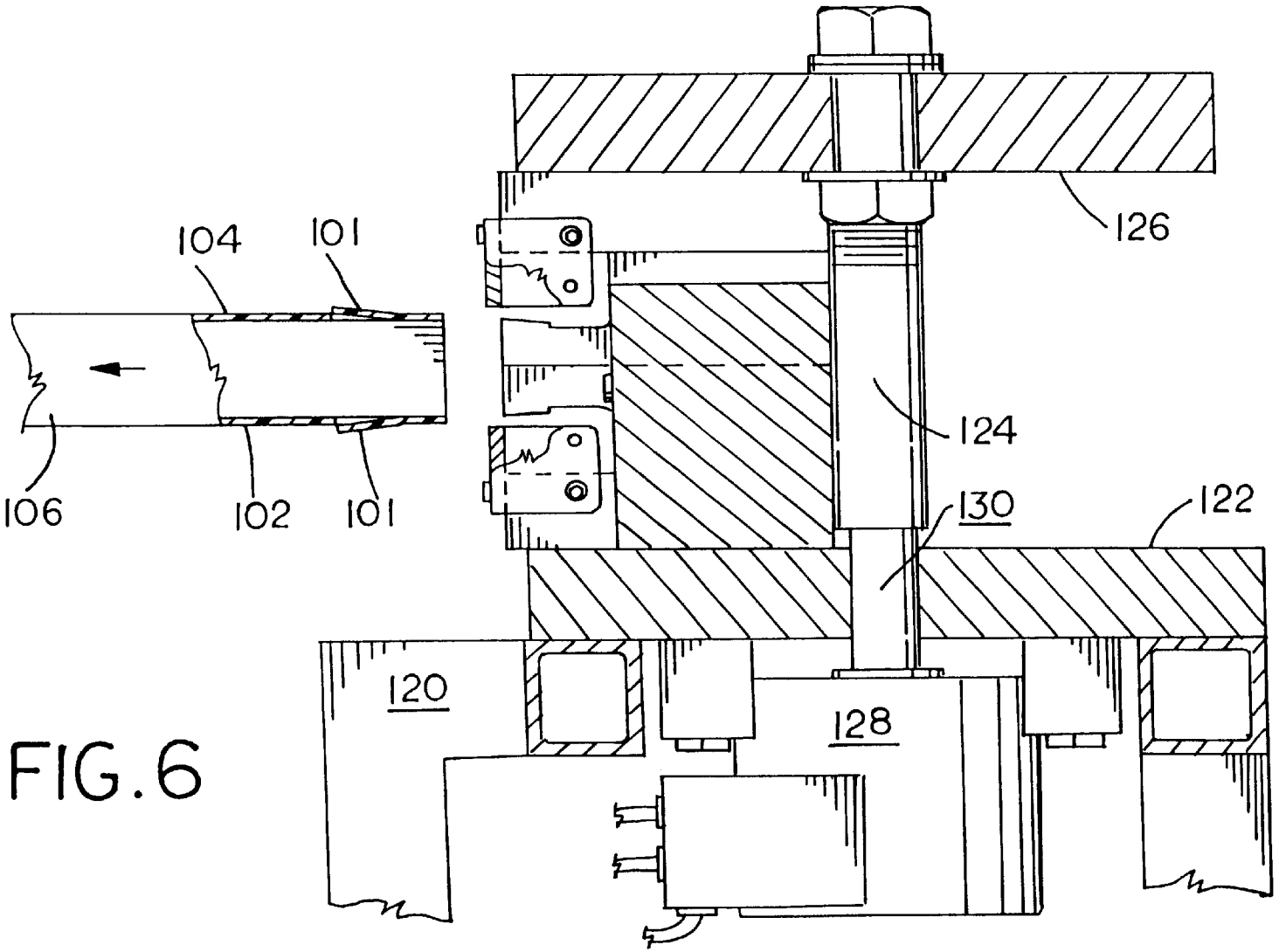
FIG. 6 is another side elevational view of the notching device of the previous Figs. but showing the workpiece removed from the apparatus after completion of the notch forming cycle.

As shown in FIG. 4, the die 114 and the punch 116 may be mounted to a common block 132 using bolts or any other suitable fasteners, with the block 132 being mounted to the fixed plate 122. Further, the die 118 and the punch 112 may be mounted to a common block 134 using bolts or any other suitable fasteners, with the block 134 being mounted to the movable plate 126. The blocks 132, 134 may be mounted to their respective plates 122, 126 using bolts or other suitable fasteners. In the disclosed embodiment, this mounting arrangement using the blocks 132 and 134 permits the upper and lower die sets 108, 110 of the notching device 100 to be easily mounted to the plates 122, 126, or to any other suitable die press assembly of the type commonly employed in the art.

It will be noted that when the notching device 100 is in an inactive position, such as that shown in FIG. 2, the punches 112, 116 may be disposed in back-to-back relationship, with an upper side 112*c* of the punch 112 in contact with a lower side 116*c* of the punch 116. With the punches 112, 116 so disposed, a gap 136 is created between the punch 112 and the die 114, and a gap 138 is created between the punch 116 and the die 118. As shown in FIG. 9, the gaps 136, 138 are sized to permit the workpiece 106 to be inserted into the notching device 100. In the disclosed embodiment, a fixed stop 140 is provided. A leading end 106*a* of the workpiece 106 will come into contact with the stop 140 when the workpiece 106 is fully inserted into the notching device 100. Accordingly, when a stop 140 of the disclosed embodiment is employed, the tips 112*b*, 116*b* of the punches 112, 116 will be accurately and consistently positioned a desired distance from the leading end 106*a* of the workpiece 106.

Figure 7:
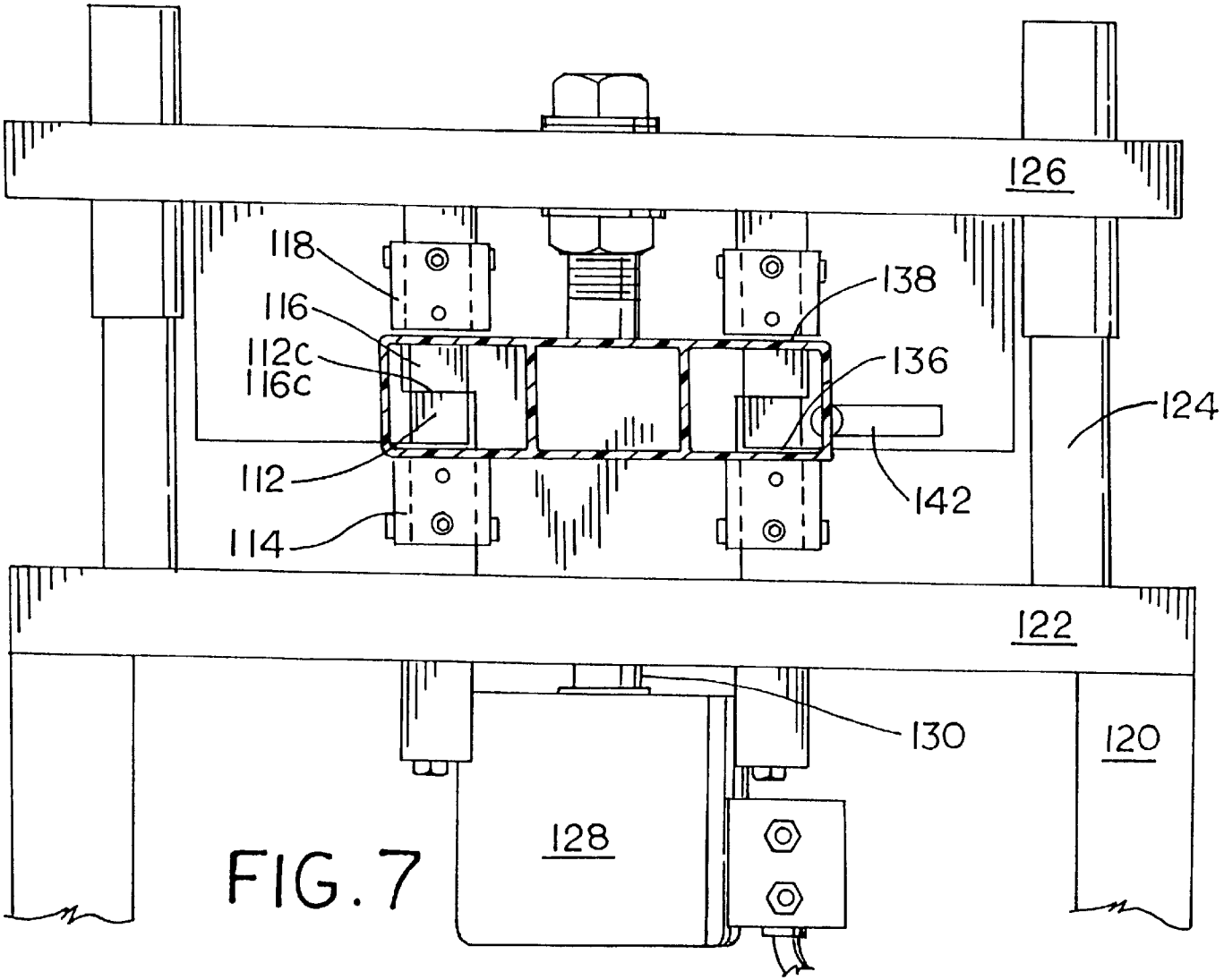
FIG. 7 is a front side elevational view of the notching device of the previous Figs. shown in the retracted or inactive position and with a workpiece (partly in section) inserted in the device.

As illustrated in FIG. 7, a contact switch 142 may be provided, with the contact switch 142 being disposed generally adjacent to the stop 140. The contact switch is operatively connected to the actuator 128, and is positioned such that the leading end 106*a* of the workpiece 106 will come into contact with and activate the contact switch 142 when the workpiece 106 is fully inserted into the notching device 100. Alternatively, floor mounted switches, foot activated switches, optical switches, or other suitable switches (not shown) may be used. In operation, the notching device 100 is initially positioned in an inactive or retracted position, such as that shown in each of FIGS. 1–3, and 5–7, As outlined above, contact between the backs 112*c*, 116*c* of the punches 112, 116, respectively, may help serve to define this inactive position. It will be noted that the fixed plate 122 and the moveable plate 126 are spaced apart by a known distance, such that the gaps 136 and 138 are created.

Figure 12:
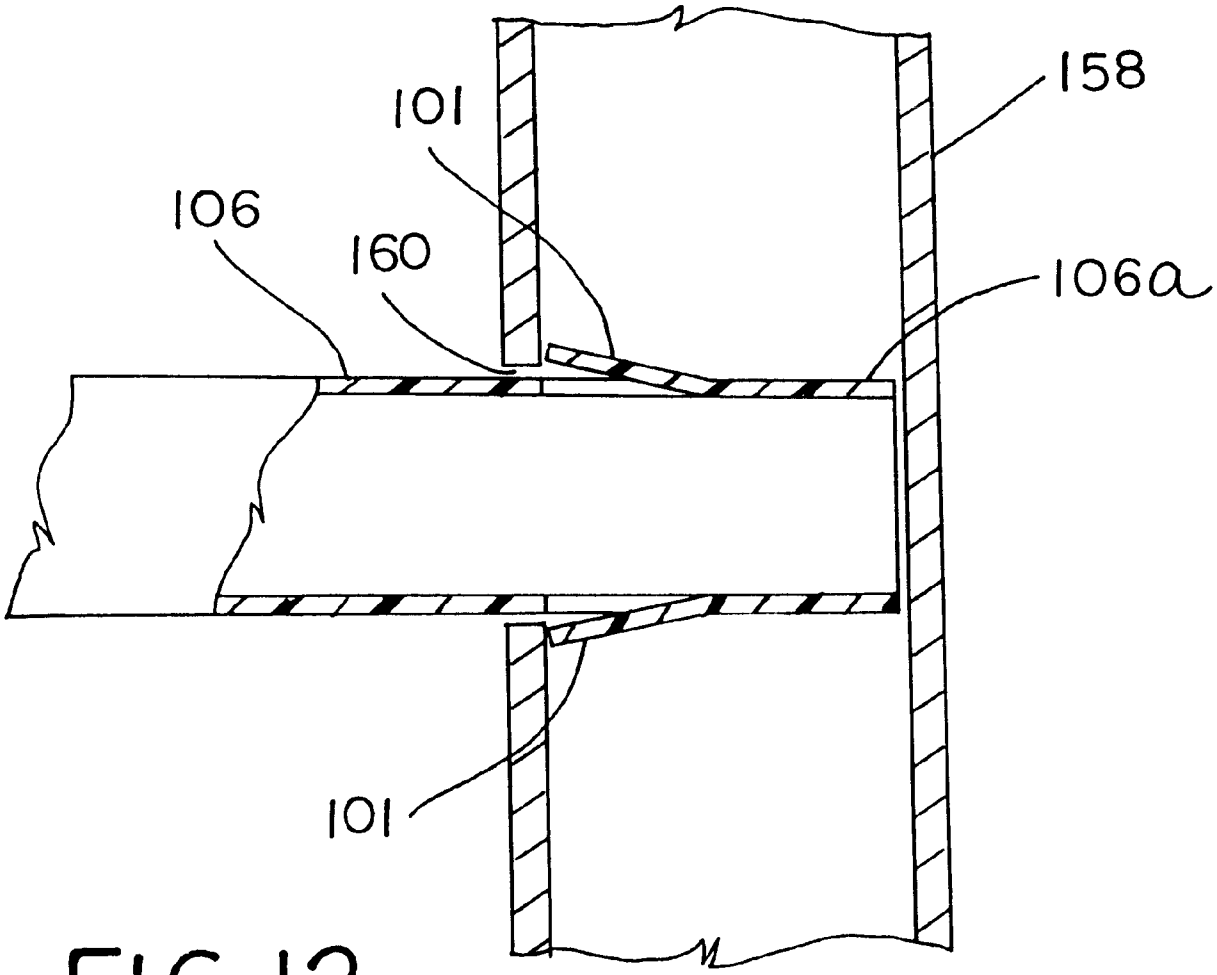
FIG. 12 is an enlarged fragmentary view in perspective view of a notched workpiece engaging a hollow member.

A workpiece 106 is then inserted into the notching device 100, with the lower surface 102 inserted into the gap 136 and the upper surface 104 inserted in the upper gap 138. Ideally, the workpiece 106 is placed so that the leading end 106*a* contacts the stop 140 such that the notches 101 to be formed will be properly placed relative to the end 106*a* (i.e, spaced inwardly form the end 106*a* the desired distance). The desired distance will depend on the overall physical dimensions of the workpiece as well as the size of the receiving aperture 160, in the member 158 shown in FIG. 12, into which the leading end 106*a* will ultimately be inserted.

When the workpiece 106 is properly positioned, the actuator 128 is actuated. As outlined above, the actuator 128 may be activated upon contact between the leading end 106*a* of the workpiece 106 and the contact switch 142, or by other suitable means (not shown).

Figure 8:
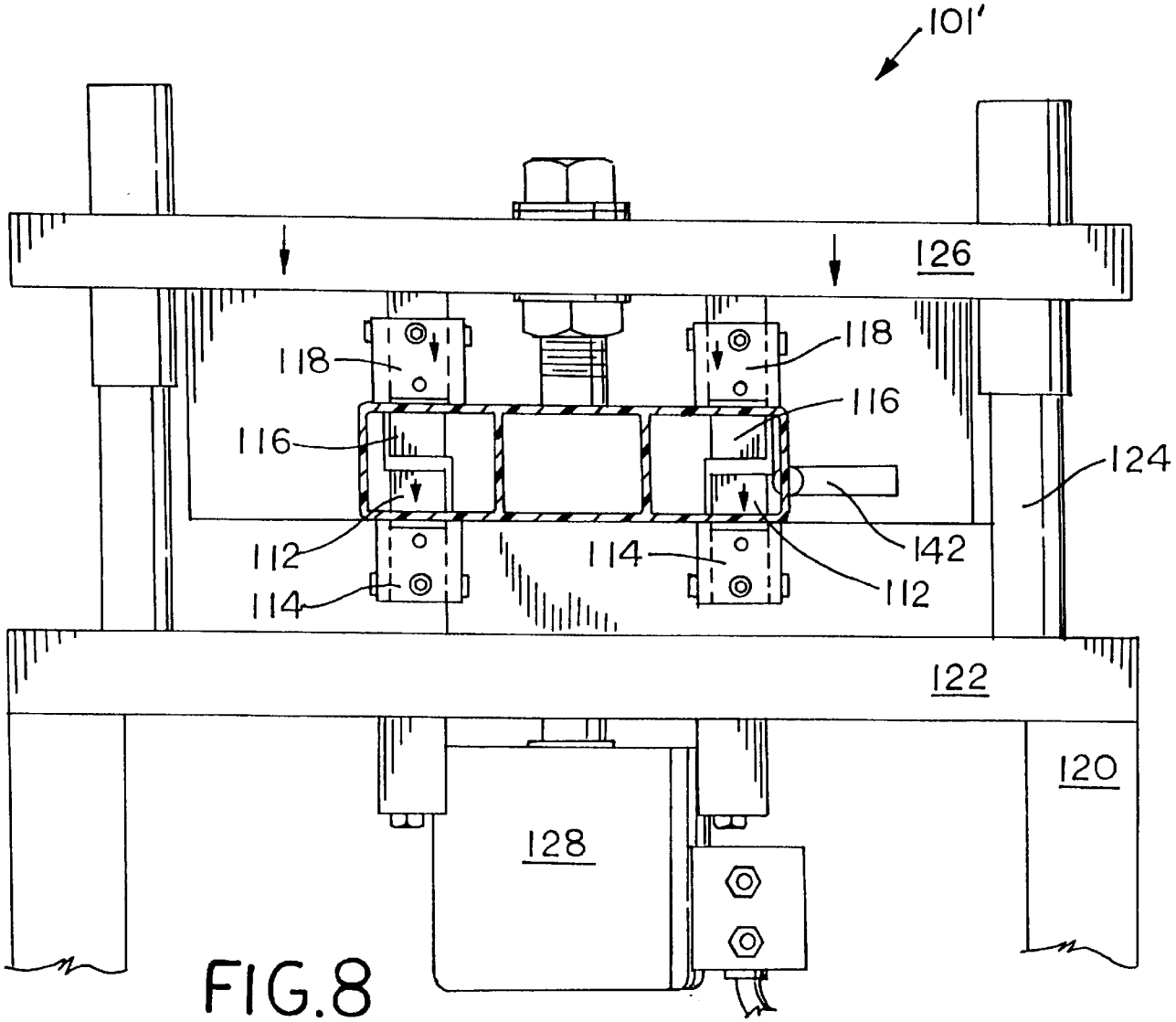
FIG. 8 is a front side elevational view similar to FIG. 7 but showing the apparatus in the active position.
Figure 10:
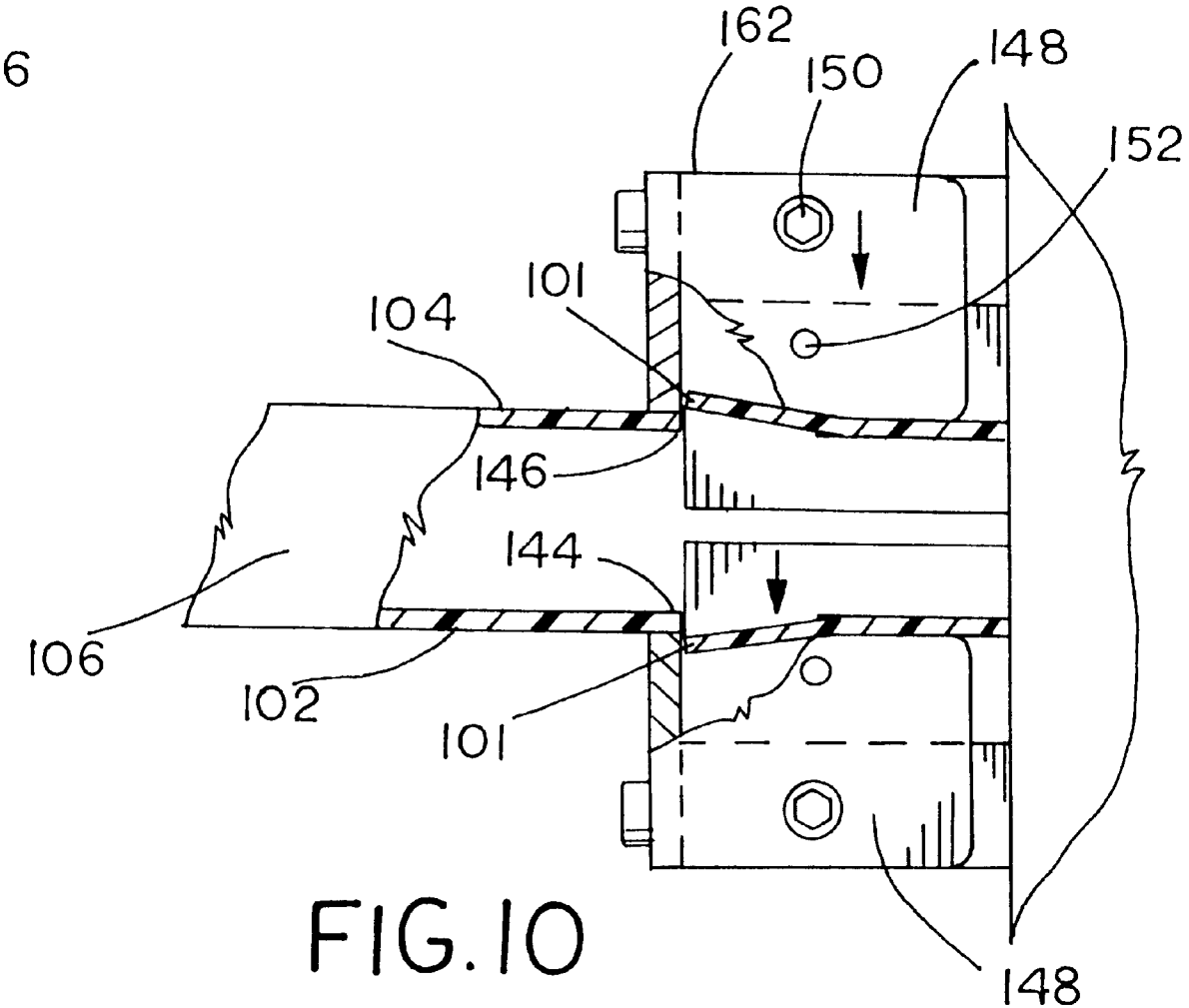
FIG. 10 is an enlarged fragmentary cross-sectional view taken along line 10—10 of FIG. 8.

When actuator 128 is activated, the rod 130 is drawn downwardly when viewing FIG. 4, which moves the moveable plate 126 closer toward the fixed plate 122, thus shifting the notching device from the inactive position of FIGS. 1–3, and 5–7, toward the active, notch forming position of FIGS. 4, 8, and 10.

In the process, the punch 112 moves into the cavity 114*b* of the fixed die 114, and the die 118 moves downwardly over the stationary punch 116, effectively moving the punch 116 into the cavity 118*b* of the die 118. The relative movement of the punches and their cooperating dies is equal to the distance traveled by the rod 130 of the actuator 128.

Figure 11:
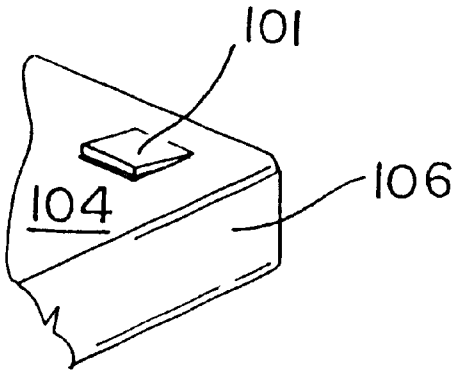
FIG. 11 is an enlarged fragmentary view in perspective view of a notch formed in a hollow workpiece.

In the process, the punches 112, 116 cut the notches 101 in the surfaces 102, 104, as the punches cut and deflect a portion of the workpiece material. The tip 112*b* of the punch 112 comes into contact with a lower inner surface 144 of the lower surface 102 of the workpiece 106. The continued downward motion of the movable plate 126 forces the tip 116*b* of the punch 116 to contact an upper inner surface 146 of the upper surface 104. Thus, as the moveable plate 126 completes its downward motion, the notches 101 are fully formed. FIG. 11 shows a perspective view of the upper notch 101, after the workpiece 106 has been removed from the notching device 100.

At the end of the cycle the actuator 128 reverses, and pushes the movable plate 126 upwardly back toward the initial, inactive position of FIGS. 1–3, and 5–7. The workpiece can then be removed from the notching device 100.

In the disclosed embodiment the actuator 128 is a double acting pneumatic cylinder mounted in a fixed position relative to the bottom surface of the fixed plate 122. Other suitable actuators such as standard hydraulic cylinders, hydraulic die presses, and mechanical die presses may be employed. The rod 130 of the actuator 128 extends through an aperture 121 in the fixed plate 122.

As illustrated in FIG. 10, in the disclosed embodiment the dies 114, 118 each may include a replaceable die element 148. Each replaceable die element 148 incorporates an upper pair 150 and a lower pair 152 of symmetrical side holes (only one hole of each pair being viewable in FIG. 9 or 10). Further, the die elements 148 will include a pair of symmetrical front holes 154, 156. The front holes 154, 156 along with the side hole pairs 150, 152 allow the replaceable die elements 148 to be removed from either die 114, 118, flipped over, and be re-connected to present a fresh cutting surface or edge 162. The ability to reuse the replaceable die elements increases the operating efficiency of the notching device 100 while reducing maintenance and operation costs.

Referring to FIGS. 1, 7–8 the notching device 100 may be paired with a similar notching device 1001, thus allowing the simultaneous creation of two pairs of notches (i.e., a left pair of upper and lower notches and a right pair of upper and lower notches) in the same action the single hollow workpiece 106 shown in FIG. 7.

It will be understood that the notching device 100 may be attached to a conventional die press with the fixed plate 122 attached to a fixed bed of the die press and the movable plate 126 attached to a movable ram of the die press in a manner that would be apparent to those skilled in the art.

Further, a commercially available die set such as the aforementioned Danly IEM® AS-34, may be incorporated into the notching device 100 to provide the movable plate 122, the fixed plate 126 and the guide posts 124 needed to mount and align the components of the notching device 100.

Those skilled in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the appended claims either literally or under the doctrine of equivalents.

What is claimed:

1. A device for forming a notch in a first surface and second surface of a hollow workpiece in a single action, the device comprising:

a first die;

a first punch, the first punch fixed relative to the first die;

a second die;

a second punch, the second punch fixed relative to the second die, the second punch and the second die being moveable relative to the first die and first punch;

whereby in response to movement of the second die and the second punch relative to the first die and the first punch, the second punch and the first die are adapted to cooperate to form a notch in the first surface of the workpiece, and the first punch and second die are adapted to cooperate to form a notch in the second surface of the workpiece.

2. The device of claim 1, wherein the device is mounted to the top support and bottom support of a die set.

3. The device of claim 1, wherein a working surface of the first die and second die are replaceable.

4. The device of claim 1, wherein a working surface of the first punch and second punch are replaceable.

5. The device of claim 1, wherein the device is mounted to a hydraulic press.

6. The device of claim 1, wherein a downward facing die and an upward facing punch and downward facing punch and an upward facing die are adapted cooperate so that the first notch and the second notch are formed simultaneously.

7. A device for notching a first surface and a second surface of a hollow workpiece in a single action, the device comprising:

a first die;

a second die, the second die movable relative to the first die, an actuator operatively connected to the second die and arranged to shift the second die between an active position and an inactive position;

a first punch, the first punch fixed relative to the first die and arranged to cooperate with the second die to form a notch on the first surface of the workpiece in response to the shift of the second die from the inactive position to the active position, a second punch, the second punch fixed relative to the second die and arranged to cooperate with the first die to form a notch on the second surface of the workpiece in response to the shift of the second punch from the inactive position to the active position.

8. The device of claim 7, wherein the actuator is a pneumatic cylinder.

9. A device for notching a first surface and a second surface of a hollow workpiece in a single action, the device comprising:

a first die set, the first die set including moveable punch and a fixed die;

a second die set, the second die set including a fixed punch and a moveable die;

an actuator operatively connected to the moveable punch of the first die set and the moveable die of the second die set for moving the moveable punch of the first die set and the moveable die of the second die set in unison relative to the fixed die of the first die set and the fixed punch of the second die set;

whereby in response to movement of the actuator the first die set forms a notch in the first surface of the workpiece and the second die set forms a notch in the second surface of the workpiece.

10. A method for notching multiple faces of a hollow workpiece in a single action comprising the steps of, providing a first die;

providing a first punch spaced away from and fixed relative to the first die;

providing a second die;

providing a second punch spaced away from and fixed relative to the second die;

the second die and the second punch movable relative to the first die and the first punch between an inactive position and an active position;

placing the workpiece between the second die and the first punch and the second punch and the first die when the first die and the second die are in the inactive position;

shifting the second die and the second punch relative to the first punch and the first die from the inactive position to the active position; and shifting the second punch and the second die, thereby forming a first notch in the first face and forming a second notch in the second face of the hollow workpiece.

11. The method of claim 10, wherein the hollow workpiece is inserted around the first punch and the second punch and between the first die and the second die.

* * * * *